US005471956A

United States Patent [19]

Watanabe et al.

[11] Patent Number: 5,471,956

[45] Date of Patent: Dec. 5, 1995

[54] HEAT-INSULATING STRUCTURE FOR COMBUSTION EQUIPMENT

[75] Inventors: Shigehiro Watanabe; Kazuhiro Ikeda; Takashi Sogabe; Toshiaki Ochi, all of Matsuyama, Japan

[73] Assignee: Miura Co., Ltd., Ehime, Japan

[21] Appl. No.: 266,261

[22] Filed: Jun. 27, 1994

[30] Foreign Application Priority Data

Jun. 29, 1993 [JP] Japan ..... 5-041299 U

[51] Int. Cl.[6] ..... F22B 5/00

[52] U.S. Cl. ..... 122/13.1; 122/14; 122/17; 122/367.1; 122/367.2; 122/367.3; 431/326; 431/328

[58] Field of Search ..... 122/13.1, 14, 17, 122/367.1, 367.2, 367.3; 431/326, 328

[56] References Cited

U.S. PATENT DOCUMENTS 3,330,324 7/1967 Milligan ..... 431/328
3,556,707 1/1971 Hine .
4,737,102 4/1988 Jinno et al. .
4,752,213 6/1988 Grochowski et al. .
4,799,879 1/1989 Laspeyres .
5,049,065 9/1991 Smith et al. ..... 431/328

*Primary Examiner*—Henry A. Bennett
*Assistant Examiner*—Siddharth Ohri
*Attorney, Agent, or Firm*—Birch, Stewart, Kolasch & Birch

[57] ABSTRACT

Discloses a heat-insulating structure for combustion equipment of such a type that a burner element of combustion equipment is insertedly disposed at an installation opening of thermal equipment such as a boiler, with a view to simplified structure and enhanced workability. In combustion equipment (B) having a burner element (20) insertedly disposed at the installation opening (1) of the thermal equipment (A) via the support frame (30) a thermal insulator (50) flush with the burner element (20) on the thermal equipment (A) side is disposed between the installation opening (1) and the outer side face of the support frame (30).

5 Claims, 5 Drawing Sheets

HEAT-INSULATING STRUCTURE FOR COMBUSTION EQUIPMENT

BACKGROUND OF THE INVENTION

1. Field of the Invention

The present invention relates to heat-insulating structures for combustion equipment, which are to be used in thermal equipment such as boilers and incinerators. More specifically, the invention relates to a heat-insulating structure for combustion equipment of such a type that the burner element of combustion equipment is installed so as to be insertedly disposed at an installation opening of thermal equipment such as a boiler.

2. Description of the Prior Art

Combustion equipment, particularly those used in thermal equipment such as boilers and incinerators, are installed to the installation opening of the thermal equipment via a thermal insulator (or sealant) so as to effectively utilize heat generated by combustion without escaping it out of the system, and to prevent combustion gas from leaking outside the thermal equipment through the portion where the combustion equipment is installed.

prior art example of such installation structure is now described with reference to FIG. 5. FIG. 5 illustrates a boiler, as a typical example of thermal equipment A, in which a multiplicity of vertical water tubes X, X, . . . are arranged in a combustion chamber in such a relatively dense state that the combustion chamber has almost no combustion space.

Referring to FIG. 5, the vertical water tubes X located on both sides are arranged in a single line on either side, with adjoining vertical water tubes X connected to each other by connecting members Y, Y, . . . , so that a pair of water tube walls generally parallel to each other are formed. This pair of water tube walls define a passage Z through which combustion flame or combustion gas from combustion equipment B is distributed. Within the passage Z, a multiplicity of vertical water tubes X, X, . . . are insertedly provided over the generally entire range of the passage Z with enough spacings to allow the combustion flame or combustion gas to be distributed.

The combustion equipment B in FIG. 5 is intended to explain the premix type gas burner as an example. The combustion equipment B comprises a premixed gas supply passage 10 defined by a wind box 11, and a burner element 20 fixed at a specified position of the supply passage 10. The burner element 20 is formed into specified shape and size by a support frame 30 and installed to the thermal equipment A so as to be insertedly disposed at an installation opening 1 of the thermal equipment A. In this installation structure, a thermal insulator 40 is installed outside the support frame 30, thereby thermally protecting the support frame 30 and moreover thermally insulating and sealing the thermal equipment A and combustion equipment B from each other.

In the above-described conventional structure, the support frame 30 needs to have a retainer 31 bent toward the surface of the burner element 20 around the support frame 30 in order to retain the burner element 20 with stability and security. However, the retainer 31 serves as a heat-receiving surface that is subject to radiated heat if the combustion flame during combustion, thus easy to overheat. This requires the retainer 31 to be covered with the thermal insulator 40 for its protection's sake.

Also, in such conventional structure as described above, since the thermal insulator 40 between the thermal equipment A and the combustion equipment B is easily damaged during installation and removal of the combustion equipment B, the thermal insulator 40 is provided in a double structure for its secure protection. More specifically, a first thermal insulator 41 is disposed outside the support frame 30, and a holder member 43 for holding the first thermal insulator 41 and a second thermal insulator 42 for protecting the holder member 43 are further provided. However, even in this structure, the first and second thermal insulators 41, 42 need to be arranged so as to cover the surface of the burner element, 20, for protection of the retainer 31.

In the above-described prior art, since the flame by the combustion equipment B is formed at a position close to the surface of the burner element 20, the thermal insulator 40 is exposed directly to the flame. As a result, there would arise a problem that the thermal insulator 40 will wear early and may be stripped off. Also, since the thermal insulator 40 needs to be arranged so as to cover the surface of the burner element 20, high level of skills would be required to install the thermal insulator 40 as another problem.

SUMMARY OF THE INVENTION

The present invention has been accomplished to solve the above described problems. An object of the present invention is therefore to provide a heat-insulating structure for combustion equipment, for use in combustion equipment having a burner element insertedly disposed at an installation opening of thermal equipment via a support frame, characterized in that a thermal insulator flush with the burner element on the thermal equipment side is provided between the installation opening and the outer side face of the support frame.

DETAILED DESCRIPTION OF THE PREFERRED EMBODIMENTS

Figure 2:
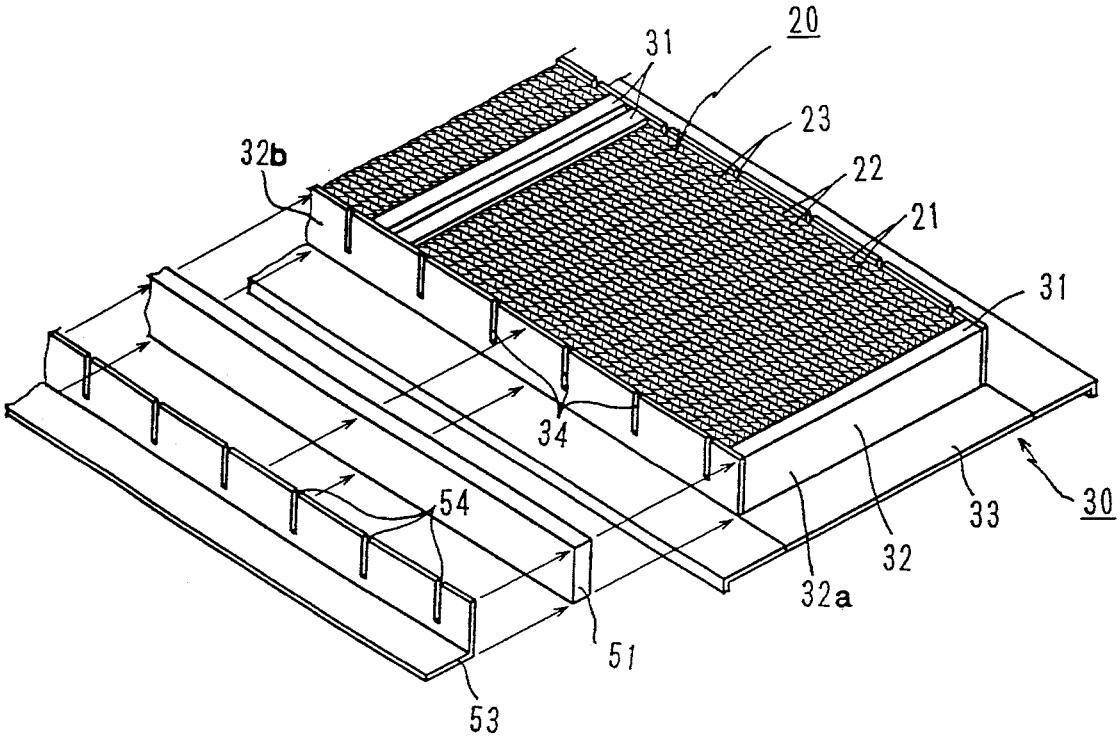
FIG. 2 is an exploded perspective view of the main part of FIG. 1.
Figure 3:
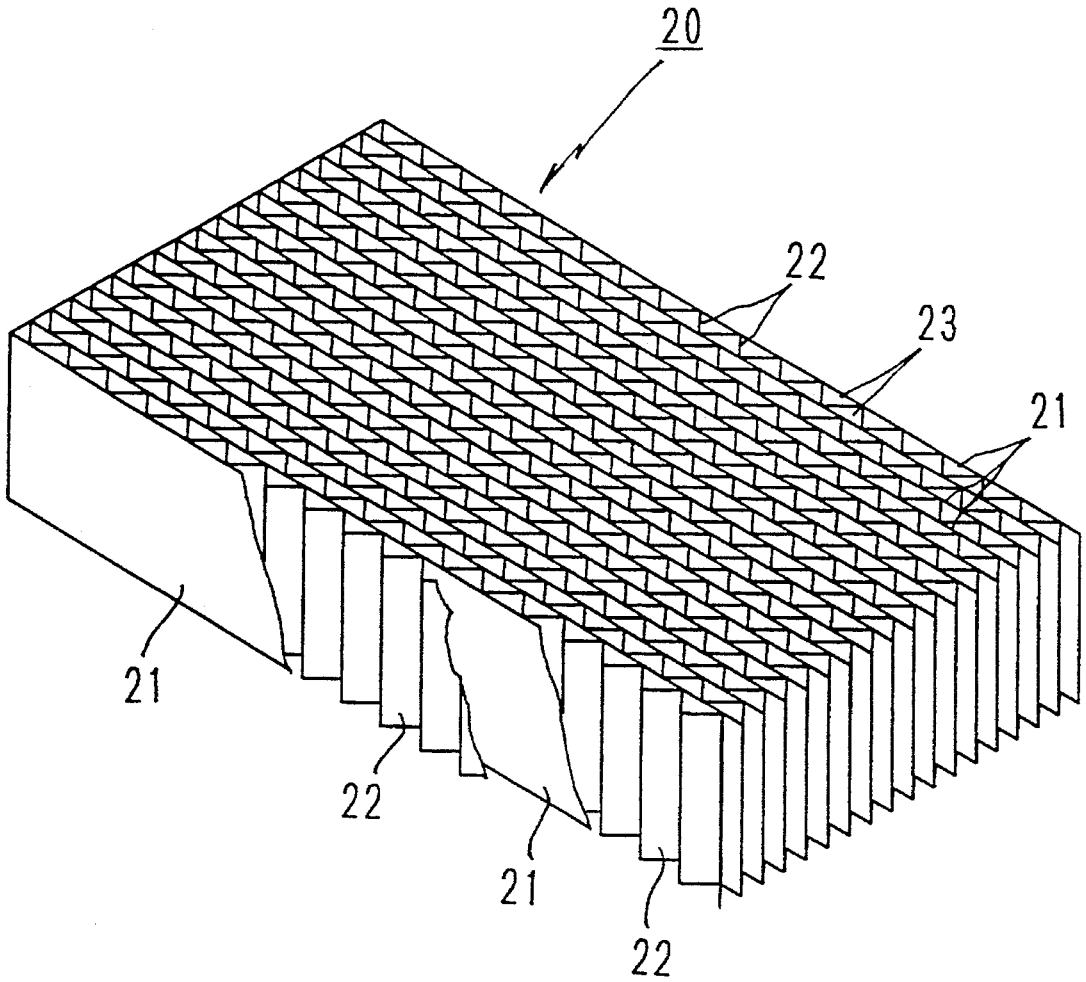
FIG. 3 is an explanatory view and partly broken view of the burner element in FIGS. 1 and 2.
Figure 5:
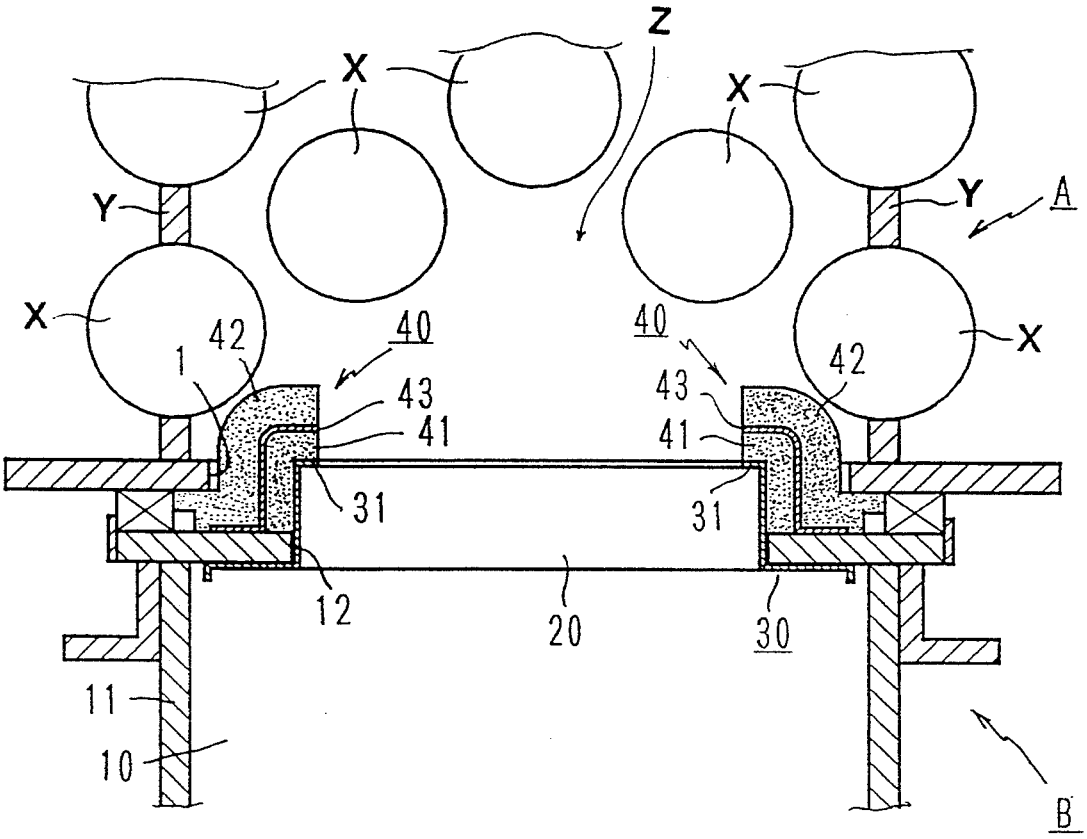
FIG. 5 PRIOR ART
FIG. 5 is a transverse explanatory view showing the conventional heat-insulating structure for combustion equipment.

A preferred embodiment of the present invention is now described in detail with reference to the accompanying drawings. The embodiment as shown in FIGS. 1 to 3 is intended to explain a boiler of the same type as illustrated in FIG. 5 as the thermal equipment A, in which case a premix type gas burner is applied as the combustion equipment B.

Figure 1:
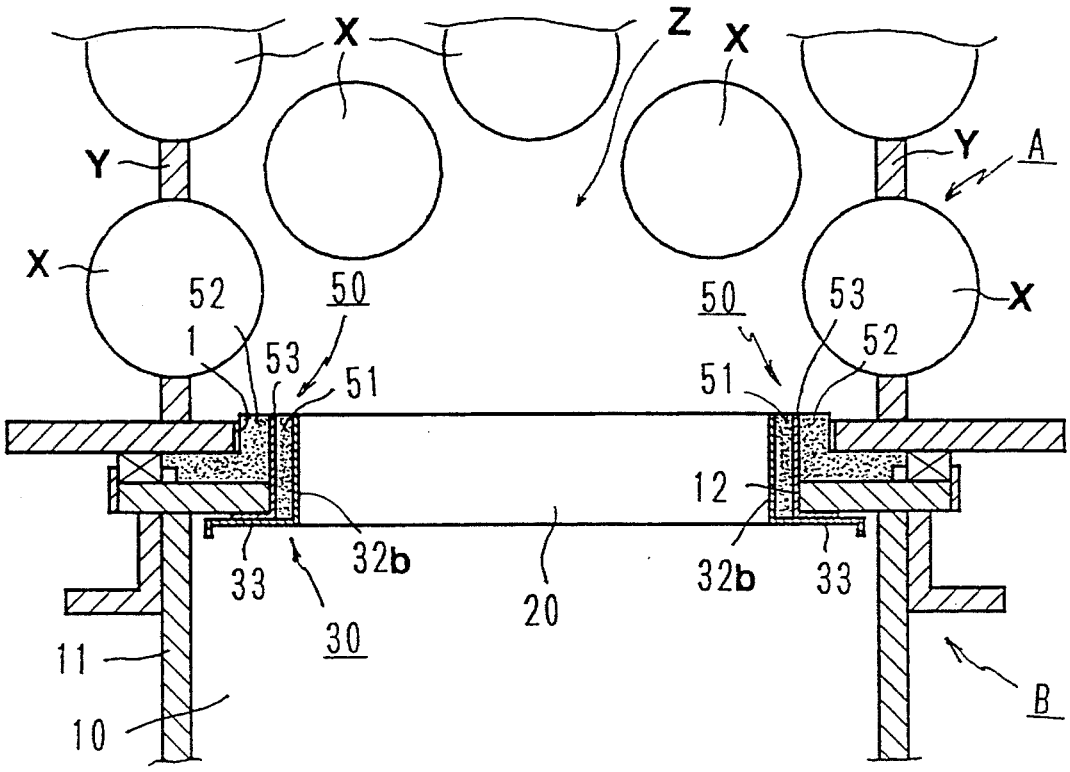
FIG. 1 is a transverse plan view showing an embodiment of the present invention.

Referring first to FIG. 1, the boiler according to this embodiment has such a body structure that the boiler has almost no combustion space as a combustion chamber, that is, a multiplicity of vertical water tubes X, X, . . . are arranged in a relatively dense state within the combustion chamber. More specifically, the vertical water tubes X located on both sides are arranged in a single line on either side, with adjoining vertical water tubes X connected to each other by connecting members Y, Y, . . . , so that a pair of water tube walls generally parallel to each other are formed.

This pair of water tube walls define a passage Z through which combustion flame or combustion gas from combustion equipment B is distributed. Within the passage Z, a multiplicity of vertical water tubes X, X, . . . are insertedly provided over the generally entire range of the passage Z with enough spacings to allow the combustion flame or combustion gas to be distributed.

The premix type gas burner, which exemplifies the combustion equipment B, is in principle installed so as to confront thermal equipment A (within the boiler body) with a burner element 20 assembled on one side face of a premixed gas supply passage 10. The supply passage 10 is in general defined by a cylindrical wind box 11. The burner element 20 is assembled at an element-installation opening 12 formed on one side face of the wind box 11.

The burner element 20, as shown in FIG. 3, has a premixed-gas blowoff passage 23 formed by alternately laminating a thin flat plate 21 and a corrugated plate 22 having a specified width (i.e., height of the burner element 20 in the vertical direction in FIG. 1). The burner element 20 is formed into specified shape and size by a support frame 30. In the case where the burner element 20 is formed into a rectangular shape, the support frame 30 comprises a frame body 32 that determines the shape of the burner element 20, and a flange 33 for securing the burner element 20 to the supply passage 10. The frame body 32 of the support frame 30 is made up of end plates **32*a*, 32*a* for retaining longitudinal both ends of the burner element 20, respectively, and side plates 32*b*, 32*b* for retaining widthwise both side faces of the burner element 20**, respectively.

The two end plates **32*a* and the two side plates 32*b* are formed into a frame shape at the same height (height of the side plates 32*b* in the vertical direction in FIG. 1), where the flat plate 21 and the corrugated plate 22 are arranged within the frame body so as to be alternately laminated. The height of the plates 32*a* and 32*b*, and therefore the height of the frame body 32 is approximately the same as the height of the burner element 20. The two end plates 32*a* are provided with retainers 31, 31, respectively, for securely retaining both ends of the flat plate 21 and the corrugated plate 22, so that the laminate of the two plates 21, 22, i.e., the burner element 20 is supported by the retainers 31. Further, as shown in FIG. 2, the two side plates 32*b* are provided with a plurality of vertical slits 34 with approximately equal intervals, so that thermal stress of the two side plates 32*b* is absorbed by the slits 34**, respectively.

As shown in FIG. 1, around the frame body 32 of the support frame 30 that supports the burner element 20, there is arranged a thermal insulator 50 in which the surface height of the thermal equipment A on the passage Z side is the same as the surface height of the burner element 20. This thermal insulator 50 is intended to prevent heat generated by the combustion equipment B from escaping out of the system and to prevent combustion gas from leaking outside the thermal equipment A, and moreover to achieve heat insulation and sealing between the thermal equipment A and the combustion equipment B. The embodiment as shown in FIG. 1 employs a double-layer structure in which a first thermal insulator 51 and a second thermal insulator 52 are arranged into a laminated state. As an actual example of this double-layer structure, as shown in FIG. 2, outside the two side plates **32*b* there are disposed the first thermal insulators 51, 51 having the same height as the two side plates 32*b* and a proper thickness (width in the horizontal direction in FIG. 1), and the two first thermal insulators 51, 51 are held and secured at their specified positions from outside by holder members 53, 53**, respectively.

The holder members 53, 53 have generally L-shaped cross sections with its rise portion at the same height as the two side plates **32*b*. This rise portion is provided with a plurality of vertical slits 54 with approximately equal intervals, as shown in FIG. 2, like the two side plates 32*b*. Thus, thermal stress of the holder members 53 is absorbed by the slits 54, respectively. Since the holder members 53, 53 will be installed integrally with the support frame 30, it is preferable to provide such a structure for installation that the thermal stress of the holder members 53, 53 can be absorbed. For example, a longhole (not shown) is bored at the flange 33 portion of the support frame 30, and the holder member 53 and the support frame 30 are fitted with a mounting bolt (not shown) by making use of the long hole, where the long hole serves also to absorb any dimensional change and thermal stress due to thermal expansion of the holder members 53, 53. Furthermore, preferably, in installing the holder members 53, 53, the first thermal insulator 51, and the support frame 30** are not merely held therebetween but bonded together by using an adhesive or the like so as to be integrally structured.

The burner element 20 integrated with the first thermal insulator 51 in this way is first mounted to the wind box 11 that defines the premixed gas supply passage 10. In doing this, the burner element 20 is inserted into the element-installation opening 12, which is provided to the wind box 11, from inside of the wind box 11, and assembled in such a way that the frame body 32 of the support frame 30 is protruded from the element-installation opening 12. In this assembled state, the outside of the wind box 11, i.e., the periphery of the support frame 30 protruding toward the thermal equipment A is covered with the first thermal insulator 51, and the further outside is covered with the holder members 53.

Then the burner element 20 mounted to the wind box 11 is insertedly disposed at the installation opening 1 of the thermal equipment A, where the second thermal insulator 52 is further disposed outside the holder members 53. The second thermal insulator 52 is also arranged to be flush with the burner element 20 on the thermal equipment A side, like the first thermal insulator 51. The second thermal insulator 52 is also installed so as to intervene between the peripheral edge of the installation opening 1 of the thermal equipment A and the peripheral edge of the element-installation opening 12 of the wind box 11, thus serving for thermal insulation and sealing between the thermal equipment A and the combustion equipment B.

With the above arrangement, on the thermal equipment A side there is no member that protrudes from the burner element 20 including the holder members 53 toward the thermal equipment A, nor part that will be overheated by radiated heat due to flames. Moreover, since the premixed-gas blowoff passage 23 in the burner element 20 is formed over the generally entire range of the burner element 20, there is no part where the premixed gas will stay, on the in-frame peripheral edge portion of the support frame 30. As a result, the support frame 30 can be effectively cooled by the premixed gas and prevented from any deformation due to thermal stress by virtue of the plurality of slits 34 provided thereto.

Further, the holder members 53 located between the first thermal insulator 51 and the second thermal insulator 52 are only exposed at their edge portions to inside of the thermal equipment A, so that the holder members 53 will be less overheated. Also, even if the second thermal insulator 52 is burned by heat so that the holder members 53 are exposed, the holder members 53 can be prevented from deformation due to thermal stress by virtue of the plurality of slits 54 provided thereto, as described before.

Further, in the above embodiment, the thermal insulator 50 arranged around the burner element 20 is provided in a double-layer structure composed of the first thermal insulator 51 and the second thermal insulator 52, where the first thermal insulator 51 is integrated with the burner element 20 and the second thermal insulator 52 is assembled to the wind box 11 with the burner element 20 fixed, This arrangement makes it easy to check the work at each working step during the installation and removal of the combustion equipment B to the thermal equipment A and during the installation and removal of the burner element 20 to the wind box 11. Also, the thermal insulator 50 can be replaced in the units of the first thermal insulator 51 and the second thermal insulator 52 with a highly successful workability and without necessitating high level of skills.

Figure 4:
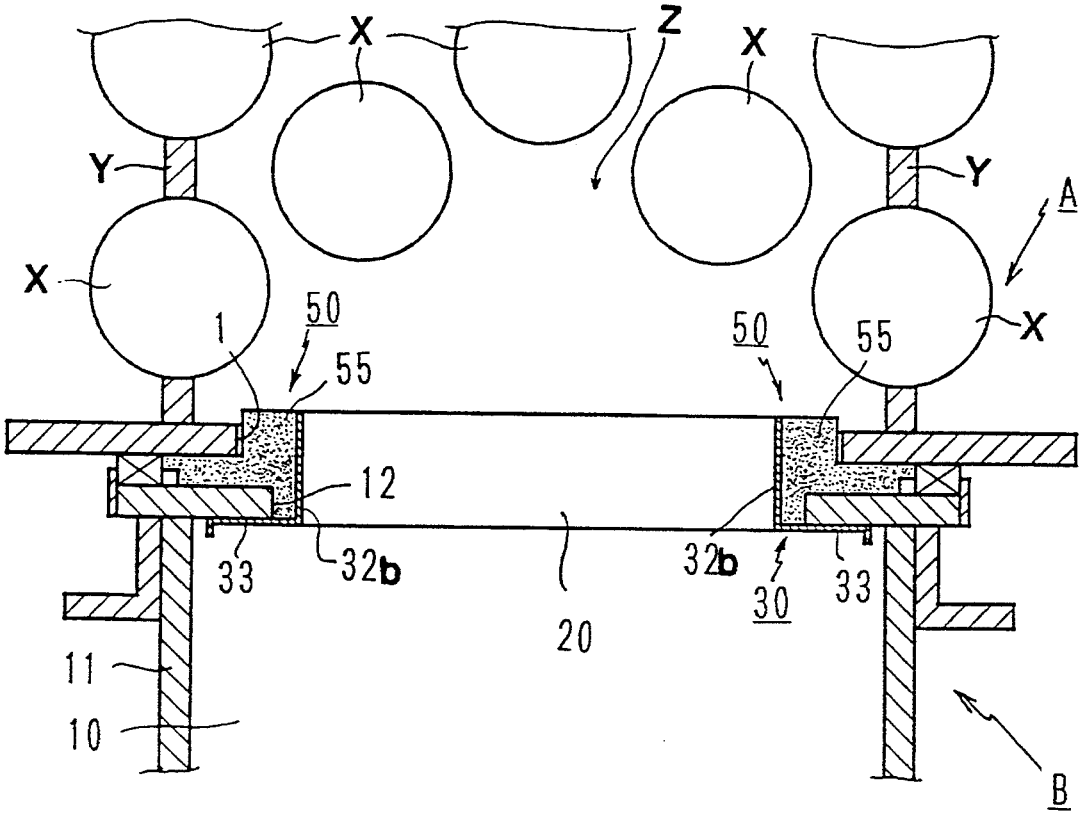
FIG. 4 is a transverse plan view showing another embodiment of the present invention.

The above embodiment has been described on a structure in which thermal insulators (the first thermal insulator 51 and the second thermal insulator 52) are intervened between the burner element 20 and the wind box 11 and between the wind box 11 and the thermal equipment A. This is a description in which removability, sealability, workability, and the like of the individual members for maintenance and inspection have been taken into account. However, in equipment that requires no, or almost no such removal, it is not necessarily required to provide a laminate structure composed of the first and second thermal insulators as described above. Instead, for example as shown in FIG. 4, it is preferable that a single-layer thermal insulator 55 is provided around the support frame 30 of the burner element 20 and between the thermal equipment A and the combustion equipment B, depending on the circumstances of embodiment of the invention. In this case, as compared with the foregoing embodiment, the holder members 53 may be omitted and therefore the structure can be further simplified with a further successful workability for removal and other processes.

Further, the above embodiments have been described in a structure in which the burner element 20 is provided by laminating the flat plate 21 and the corrugated plate 22. However, the present invention is not limited to this, but allows other structures, for example, that a multiplicity of premixed-gas blowoff holes are bored in an heat-resistant flat plate member. In such cases, also, advantages equivalent to the foregoing embodiments can be offered.

What is claimed is:

1. A heat-insulating structure for combustion equipment, for use in combustion equipment (B) having a burner element (20) insertedly disposed at an installation opening (1) of thermal equipment (A) via a support frame (30), the heat-insulating structure comprising a thermal insulator (50) which is provided between the installation opening (1) and an outer side face of the support frame (30) and which is flush with the burner element (20) on the thermal equipment (A) side.

2. The heat-insulating structure for combustion equipment according to claim 1, wherein said thermal insulator (50) is of a double-layer structure made up of a first thermal insulator (51) and a second thermal insulator (52) via a holder member (53) integrated with said support frame (30).

3. The heat-insulating structure for combustion equipment according to Claim 2, wherein said first thermal insulator (51) is insertedly disposed at said installation opening (1) in such a state that said first thermal insulator (51) has previously been integrated with said burner element (20).

4. The heat-insulating structure for combustion equipment according to claim 1, wherein said burner element (20) is formed by alternately laminating a flat plate (21) and a corrugated plate (22), and said support frame (30) is formed into a frame shape by end plates (32*a*) for retaining both longitudinal ends of said burner element (20), respectively, and side plates (32*b*) for retaining both widthwise side faces of said burner element (20), respectively.

5. The heat-insulating structure for combustion equipment according to claim 1, wherein said thermal equipment (A) is a boiler comprising a pair of water tube walls, and a can structure in which a multiplicity of vertical water tubes (X) are insertedly provided in a relatively dense state within a passage (Z) defined by the pair of water tube walls.

* * * * *